US008061255B1

(12) United States Patent
Boberg

(10) Patent No.: US 8,061,255 B1
(45) Date of Patent: Nov. 22, 2011

(54) FIREARM WITH CARTRIDGE PICK-AND-PLACE MECHANISM

(76) Inventor: Arne Bengt Boberg, Shoreview, MN (US)

( * ) Notice: Subject to any disclaimer, the term of this patent is extended or adjusted under 35 U.S.C. 154(b) by 423 days.

(21) Appl. No.: 12/321,744

(22) Filed: Jan. 26, 2009

Related U.S. Application Data

(60) Provisional application No. 61/063,099, filed on Feb. 1, 2008.

(51) Int. Cl.
*F41A 9/00* (2006.01)

(52) U.S. Cl. ..... 89/33.1; 89/33.01; 42/17; 42/16; 42/18

(58) Field of Classification Search ..... 89/33.16, 89/33.17, 33.25, 33.03, 33.1, 33.01; 42/15, 42/39.5, 16, 18, 17
See application file for complete search history.

(56) References Cited

U.S. PATENT DOCUMENTS

| | | | | |
|---|---|---|---|---|
| 317,162 | A | 5/1885 | Maxim | |
| 395,791 | A | 1/1889 | Maxim | |
| 465,339 | A * | 12/1891 | Browning et al. | 42/18 |
| 580,935 | A | 9/1897 | Ehberts | |
| 618,743 | A | 1/1899 | Silverman | |
| 663,955 | A | 12/1900 | Burgess | |
| 666,084 | A | 1/1901 | Burgess | |
| 687,448 | A | 11/1901 | Burgess | |
| 693,105 | A | 2/1902 | Burgess | |
| 729,858 | A | 6/1903 | Gass | |
| 1,293,021 | A | 2/1919 | Browning | |
| 1,376,456 | A | 5/1921 | Moore | |
| 1,451,443 | A | 4/1923 | Fowler | |
| 2,765,557 | A * | 10/1956 | Roper | 42/17 |
| 2,887,808 | A * | 5/1959 | Janson et al. | 42/17 |
| 3,732,643 | A * | 5/1973 | Wells | 42/50 |
| 4,676,017 | A | 6/1987 | Hürleman | |
| 4,744,164 | A * | 5/1988 | Rieger | 42/18 |
| 4,984,504 | A | 1/1991 | Beretta | |
| 5,678,340 | A | 10/1997 | Moon | |
| 6,415,719 | B1 * | 7/2002 | Buccelli et al. | 102/457 |
| 6,898,888 | B2 | 5/2005 | Greenhut | |

FOREIGN PATENT DOCUMENTS

| | | |
|---|---|---|
| GB | 25656 | 12/1905 |

* cited by examiner

*Primary Examiner* — Michael Carone
*Assistant Examiner* — Daniel Troy
(74) *Attorney, Agent, or Firm* — Wood, Herron & Evans, LLP

(57) ABSTRACT

A firearm comprising a frame, a barrel joined to the frame, and a cartridge magazine selectively joinable to the frame; at least one cartridge contained within the cartridge magazine with the cartridge having a casing and at least one projectile, the casing having a cartridge case flange at one end and a mouth on the opposite end; and mechanism for lifting in selective communication with the cartridge and the barrel, with the mechanism for lifting having a ramp that is located adjacent to the end of the cartridge at the cartridge case flange, where the ramp acts selectively on the flange and casing; an extractor rib and barrel rib cooperating to keep extractor locked during cartridge ignition and unlocked substantially after ignition.

10 Claims, 13 Drawing Sheets

SECTION AC-AC

DETAIL AD
SCALE 5X

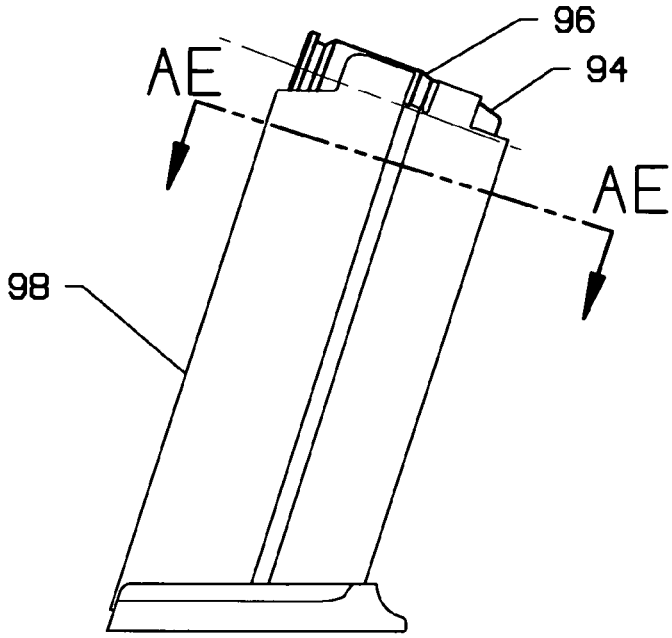
FIGURE 16
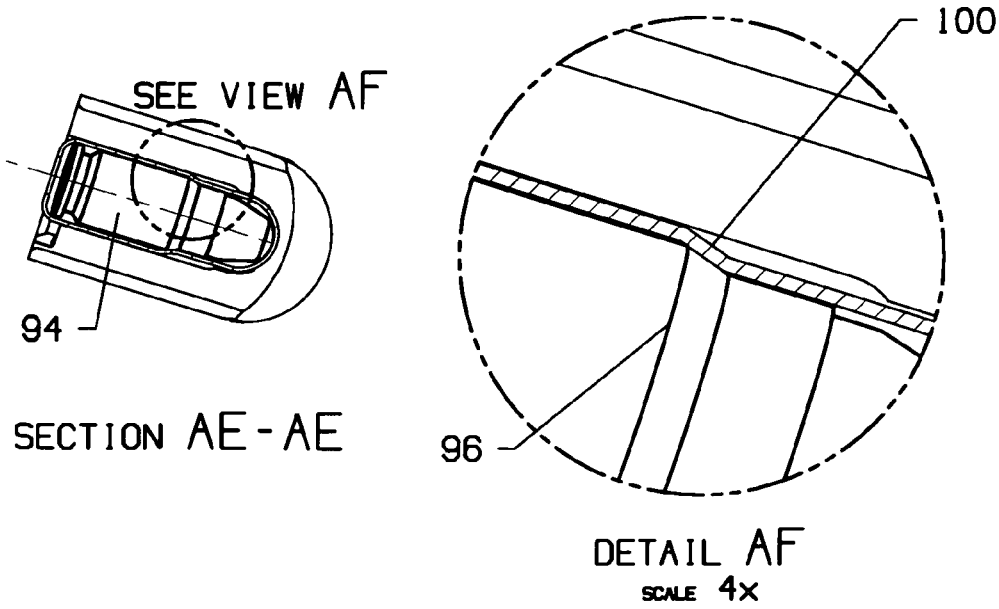

FIREARM WITH CARTRIDGE PICK-AND-PLACE MECHANISM

CROSS-REFERENCE TO RELATED APPLICATIONS

This Non-Provisional patent application claims the benefit of the filing date of U.S. Provisional Patent Application Ser. No. 61/063,099 filed Feb. 1, 2008, entitled "Firearm with Cartridge Pick-and-Place Mechanism"

FIELD OF INVENTION

The present invention relates to automatic breech-loading firearms, more specifically to cartridge feeding systems.

BACKGROUND OF INVENTION

Automatic and semi-automatic firearms require manipulation of the next cartridge. The manipulation normally occurs through springs applying a force against the cartridge. Opening the chamber to eject a shell or spent cartridge stores energy in the slide spring and the magazine spring to a point where the springs release to "kick" a fresh cartridge into place. This type of mechanism, which is found in most semi-automatic firearms, lacks a positive grip on the cartridge, and usually has a feeding ramp in front of the cartridge, leading to numerous cartridge handling errors made more acute as the springs degrade.

One of these errors is known as a "feed ramp jam", where the bullet tip stops against the feeding ramp surface, preventing the bolt from fully reaching battery position. Self-defense bullets, such as hollow-points are more prone to feed ramp jams due to their sharp corners on the tip.

Another error is incurred when the cartridge gets ahead of the extractor so that the slide will not fully go into battery.

Another error is known as "rim-lock", where cartridge rims catch on each other in the magazine, which stops the slide from reaching its battery position.

Yet another error, known as "failure to extract", is where the spent case remains in the chamber after ignition. It can be caused by percussion gases making the extractor lose its grip on the cartridge.

Another drawback of traditional feed systems is that they leave little room for the barrel. Short barrels do not provide enough burn time for propellant inside of the barrel, so instead the propellant burns on the outside, significantly increasing muzzle flash and noise. Short barrels also reduce bullet energy.

The most common cartridge feeding system is depicted in Hiram Maxim's 1885 U.S. Pat. No. 317,162, where positive control of the cartridge is not exercised.

Past examples of controlled or "positive" cartridge manipulation include U.S. Pat. No. 395,791 to Hiram S. Maxim dated Jan. 8, 1889. However, its design was bulky and not a practical solution for smaller weapons such as pistols.

Another example is GB Pat. No. 25,656 dated Sep. 27, 1906 to Mars Automatic Pistol Syndicate discloses a "pull-back"-style mechanism in a pistol. However, the gun's feed mechanism did not positively control the cartridge at all times, nor did it have means of arresting or trapping the upward motion of the cartridge to prevent feed failures.

Blow-forward feeding systems maximized barrel length, but never implemented positive cartridge manipulation. One example is U.S. Pat. No. 580,935 to C. J. Ehbets on Apr. 20, 1897.

Rotating barrel weapons have not taken advantage of the barrel rotation to lock the extractor closed during ignition. One example of a rotating barrel gun without extractor-locking is found in U.S. Pat. No. 4,984,504 to Pier G. Beretta on Jan. 15, 1991.

What is needed is a compact cartridge feeding system that eliminates the need for the front feed ramp of traditional cartridge feeding systems, and benefits from the positive nature of rearward-feeding systems that grasp a cartridge from the magazine, controls its motion at all times, and does not release it until during ejection from the firearm. What is also needed is a feeding mechanism that maximizes barrel length. What is additionally needed is an extractor that locks against the cartridge rim during ignition.

SUMMARY OF INVENTION

Considered broadly, firearms according to the invention are of the semi-automatic or fully-automatic type and include a frame, a barrel joined to the frame, a cartridge magazine selectively joinable to the frame, at least one cartridge contained within the cartridge magazine, with the cartridge having a casing and at least one projectile, the casing having a cartridge case flange at one end and a mouth on the opposite end; and a mechanism for lifting in selective communication with the cartridge and the barrel. The mechanism for lifting has a ramp that is located adjacent to the end of the cartridge at the cartridge case flange, where the ramp acts selectively on the flange and casing; an extractor rib and a barrel rib cooperating to keep extractor locked during cartridge ignition and unlocked substantially after ignition. This combination provides positive control of the cartridge from the extraction out of the magazine to the ejection of the fired case.

BRIEF DESCRIPTION OF FIGURES

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description.

FIG. 10A shows the slide in the battery position with a cartridge in the chamber and one in the magazine being gripped by the tongs FIG. 10B shows the slide part way back with the cartridge riding over the ramp and the spent case touching the cartridge FIG. 10C shows the slide further back with the spent case ejected and cartridge lifting being initiated FIG. 10D shows he slide fully back with a cartridge being trapped in topmost position FIG. 10E shows the slide almost fully forward with a fresh cartridge mostly in the chamber and the tongs starting to engage the next cartridge in the magazine FIG. 12A shows the ejector in the active position FIG. 12B shows the ejector being cammed out of the way of a rising cartridge FIG. 16 shows a proposed single-column magazine that contains and locates bottle necked cartridges

DETAILED DESCRIPTION

Basic Components

Figure 1:
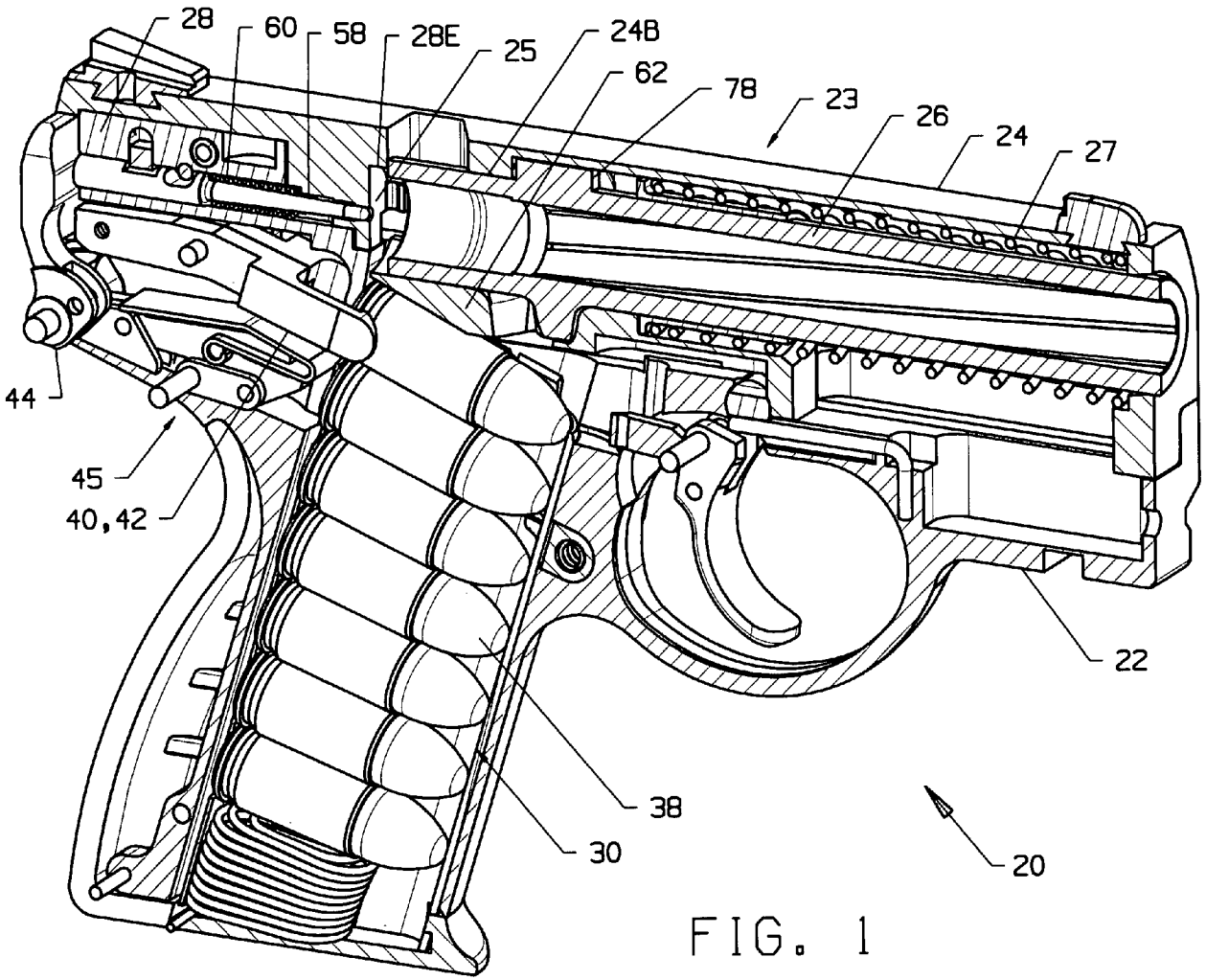
FIG. 1 is a cross section of the firearm taken along the middle, showing all major parts.

The invention is a gun or firearm 20 comprised of four basic components: a frame 22, a sliding bolt assembly 23, a lifting mechanism 45, and a magazine 30 to contain a column of cartridges 38 (see FIG. 1). The frame provides mounting for these three assemblies.

Figure 7:
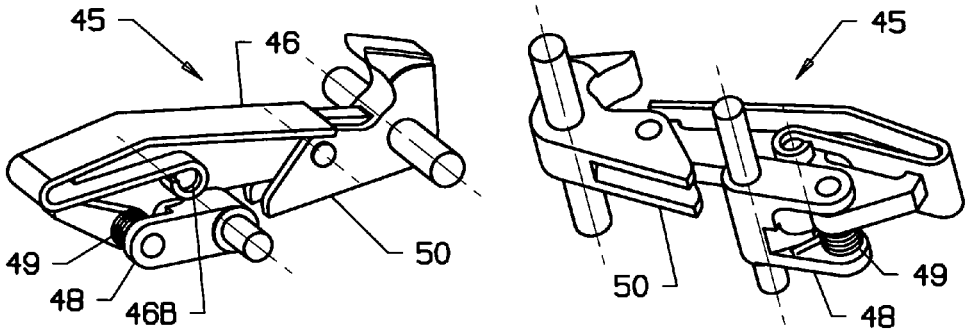
FIG. 7 shows two isometric views of the lifting mechanism

The lifting mechanism 45 (FIGS. 1 & 7) is located directly behind the magazine 30, both of which are substantially below the sliding bolt assembly 23. The cartridge is trapped in front of the breech face 25 when the sliding bolt assembly is in the rearward position.

Sliding Bolt Assembly

The sliding bolt assembly 23 is movable from a battery position (FIG. 10A) to a rearward position (FIG. 10D) relative to the frame 22, the magazine 30, and the lifting mechanism 45, and contains such standard components as the firing pin 58 (FIG. 1) and its return spring 60, barrel 26, slide return spring 27. Unique to the invention is the combination of the slide or sliding bolt 24 and insert block or secondary block 28 with a feeding extractor or tongs 40,42.

The sliding bolt 24 contains two recesses, 28E&24B that act as vertical stops for the cartridge 38 being biased upwardly by the lifting mechanism 45: one at the breech face 25, consisting of a first concave surface 28E facing downward (see FIG. 1 and FIG. 10D) and one forward of the breech face 25, a second concave surface 24B also facing downward. The first concave surface 28E protrudes from the breech face 25 and serves as a vertical stop for the cartridge case flange 38A. The second concave surface 24B is a groove that is normally occupied by the barrel when the sliding bolt is in battery position. This groove limits the vertical and horizontal travel of the forward portion of the cartridge 38. The extractor 52 (FIG. 11) is mounted to enable it to pivot in the sliding bolt 24 (FIG. 6 and FIG. 14A) with a biasing spring diametrically opposing the grip slot 28C in the insert block 28, allowing the cartridge 38 to be captured in between. It is important to note that the grip slot 28C does not capture the cartridge case flange completely, as has been done in pull-back style machine guns. The grip slot 28C has a lead-out chamfer (shown adjacent to 28C in FIG. 6), which allows the cartridge case flange 38A to slip out, and the cartridge case 38C to swing out, when impacted by the ejector 54. In other words, the grip slot 28C does not have a positive grip on the case flange 38A.

The secondary block 28 is mounted into the underside of the sliding bolt 24 via a flexible pin 32 (FIG. 10A) crossing through both parts in a direction perpendicular to the slide travel direction. The secondary block 28 has a hook or abutment 28A (FIG. 6 and FIG. 10C), which is used to actuate the lifting mechanism 45, a cam-forward face 28D (FIG. 10D) to force the lifting mechanism 45 back down, and a transverse pivot hole 29 to accept the tong pivot pin 56 (FIG. 4 and FIG. 5), which attaches the left hand tong 42 and right hand tong 40 to the insert block 28 (FIG. 6). The pivot hole 29 in each tong is shaped to not only allow rotation about its pivot pin axis, but to also allow the tongs to open and close. Each tong 40, 42 has a lead-in or beveled surface 40C & 42C that spread the tongs 40, 42 open while engaging a cartridge from the rear. Each tong has a mating feature, such as the right tong lug 40E and the left tong slot 42D which combined with the pivot pin 56 keeps the tongs parallel to each other, although the lug 40E and the slot 42D can be reversed or a pin crossing through both tongs could be used instead. Each tong 40, 42 has a gripping edge 40A, 42A that engages with the cartridge case flange 38A for positive rearward draw. The tong gripping edges 40A, 42A are biased towards each other via the tong spring 68 which uses the tong pivot pin 56 as a fulcrum. Each tong also has a chamfered lower inlet 40D that allows a case flange 38A to enter from below during magazine insertion. Each tong has a curved cam groove 40B & 42B underneath (FIG. 4 and FIG. 10E) that cooperates with the lifting mechanism 45 for downward tong biasing during the return stroke of the sliding bolt assembly 23.

Lifting Mechanism

Figure 8:
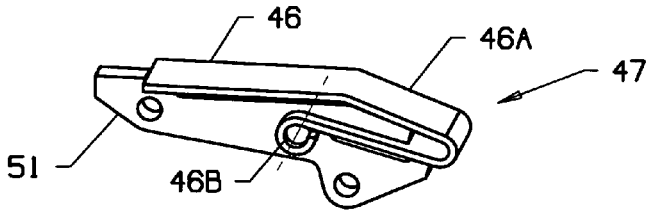
FIG. 8 is an isometric view of the coupler link assembly
Figure 9:
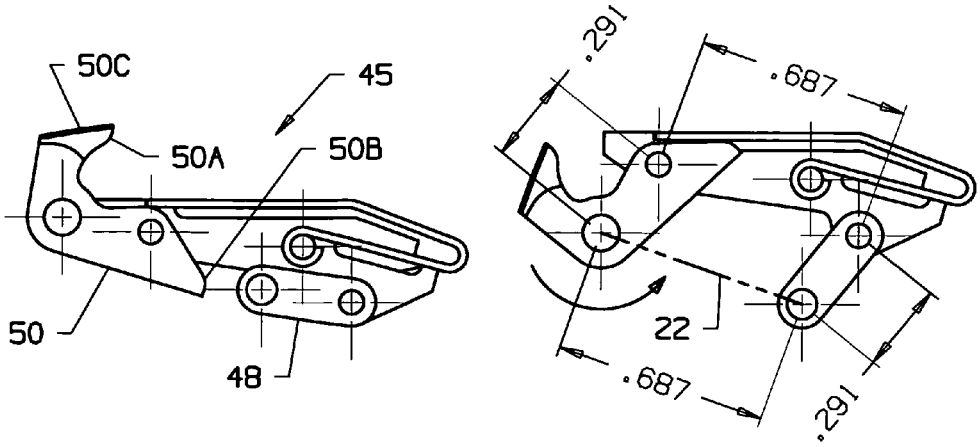
FIG. 9 shows a retracted and partially extended view of the lifting mechanism Relative link lengths are also shown. The example is used for 9 mm ammunition
Figure 10A:
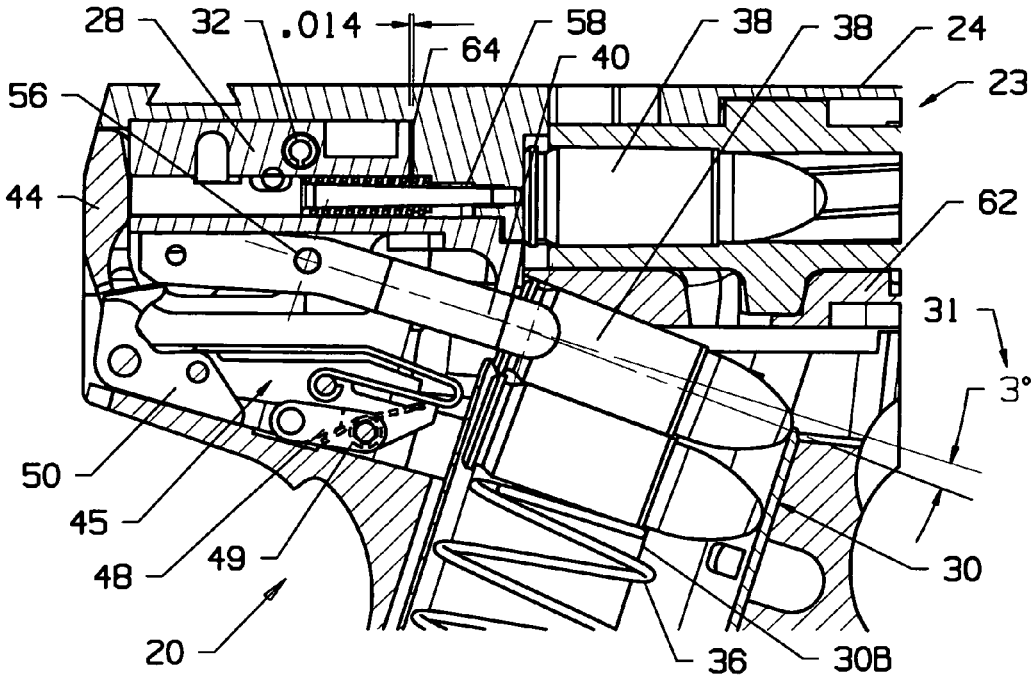
FIG. 10A-E are cross sections through the centerline of the firearm in the feed mechanism area. Each figure represents a different stage of slide motion
Figure 10B:
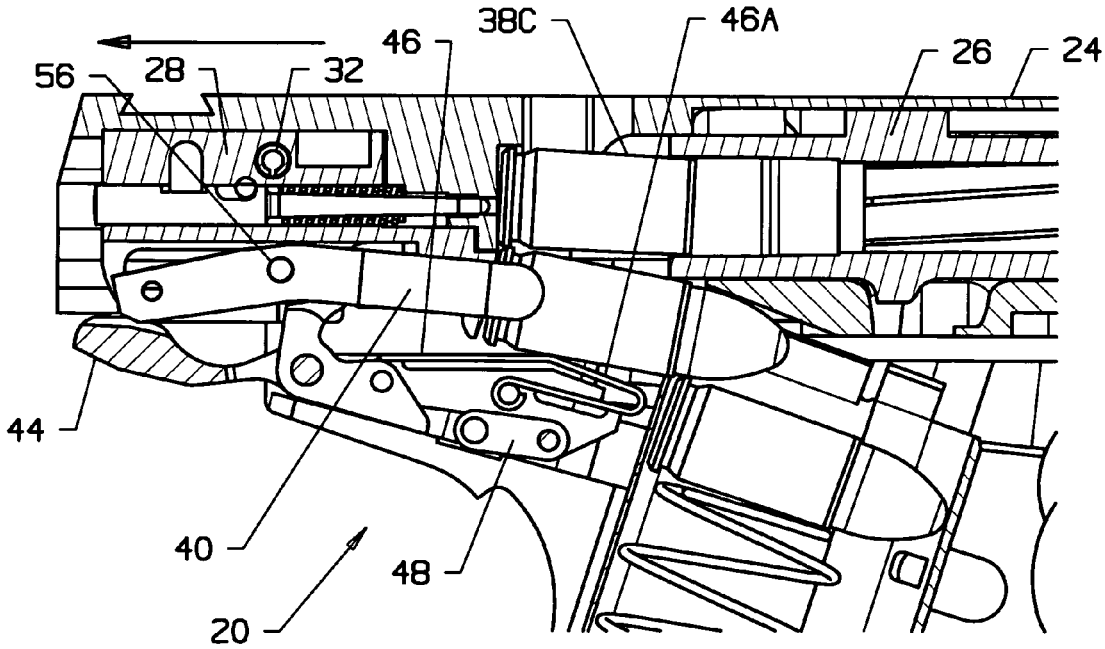
Figure 10C:
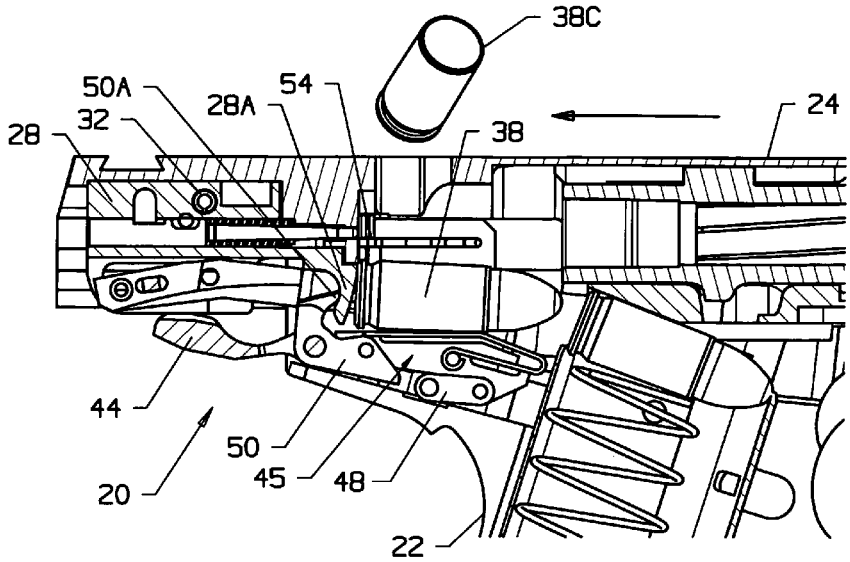
Figure 10D:
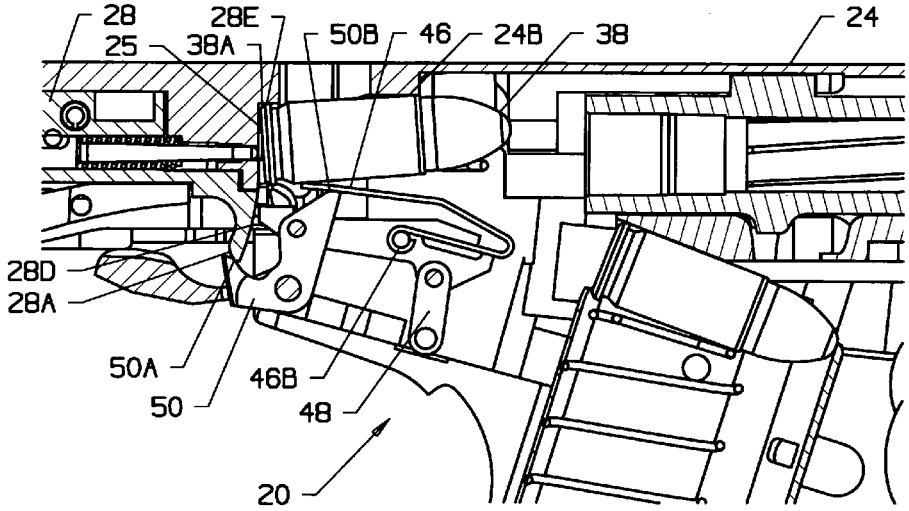
Figure 10E:
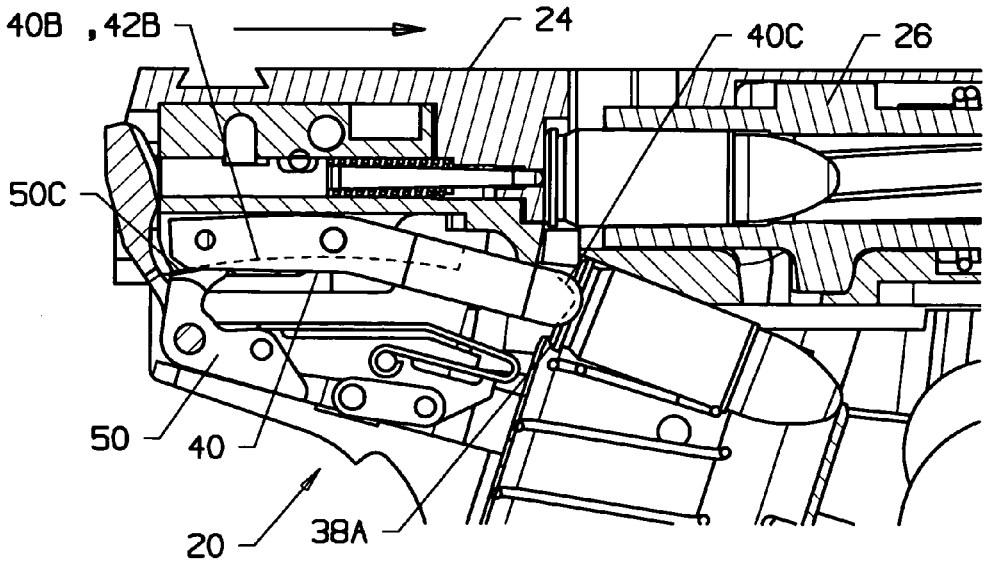

The lifting mechanism 45 is a mechanism that swings from a lower position to an upper position (FIG. 9). It is comprised of a flip link or first link 50 a lower link or second link 48, a coupler link or third link 47 (FIG. 8), and a torsion spring 49 to bias the mechanism in the lower position (FIG. 10A). The first link 50 and second link 48 are pivotably attached to the frame (FIG. 10A). The third link 47 connects the first link 50 to the second link 48 via pivot pins on either end. The third link 47, in the illustrated example is comprised of a link body 51 and a ramp 46 (FIG. 8). The third link could be configured whereby the ramp 46 and coupler link 51 are as one piece. The link body 51 serves as a mounting base for the ramp 46, which curls around a cross pin 46B that is attached to the link body 51. A forward slope 46A is also formed into the ramp 46 to guide a cartridge 38 upward and rearward from the magazine 30 (see also FIG. 10B). The ramp 46 is supported on both ends by the link body 51 and has an unsupported free span between both ends that is able to flex downward while lifting a cartridge. The rearmost end of the ramp 46 is cantilevered so that it can be lifted by the flip link nose or second cam surface 50B (FIG. 10D). The first cam surface 50A is specially-shaped to receive input from the rearward-traveling secondary block abutment 28A to provide actuation of the lifting mechanism. The shape of the first cam surface 50A cooperates with the shape of the abutment 28A to produce lifting velocity and acceleration that is less than the sliding bolt assembly 23 velocity and acceleration, such that cartridge 38 contact with the ramp 46 top surface is substantially maintained throughout the lift. A cam back or third cam surface 50C (FIG. 10E)

on the first link 50 engages the tong grooves 40B & 42B to reset the tongs 40 & 42 in the down position when the sliding bolt assembly 23 is fully forward.

Ejector

The ejector or ejector lever 54 (FIG. 12A, 12B) is mounted to the frame 22 in a location that impacts the cartridge case flange 38A below its centerline, which is where the ejector 54 passes through the ejector slot 28B. Slightly above the barrel 26 centerline, the cartridge is contained by the grip slot 28C (FIG. 6), which is opposed by the spring-loaded extractor 52 (FIG. 6).

The ejector 54 (FIG. 10C and FIG. 12A, 12B) hinges at pivot 59 relative to the frame 22 and is biased in a direction that forces collision with the spent case 38C.

The spring member 66 is mounted into the frame 22 and acts upon the ejector lever 54 to force it against the ejector stop 57, also built into the frame 22. The ejector tail 55 is integral with the ejector lever 54 and cooperates with a cam surface 24A on the sliding bolt 24 to drive the ejector lever 54 in a counterclockwise direction (viewed from the top) when avoiding a rising cartridge 38.

Cartridge Magazine

The cartridge magazine or magazine assembly 30 (See FIG. 2 & FIG. 3), which can be a traditional box-style, encloses a single column of cartridges 38 and is partially contained within the frame 22 when installed. The magazine 30 is comprised of a body or tubular structure 30A, a spring 36, a floor plate 37, lips 30C, and a rib 30B that references the cartridge case mouth 38B, preventing forward axial motion of cartridges contained within the tubular structure 30A. The rib 30B should extend entirely along the column of cartridges 38 so that upwardly flowing cartridges are not interrupted by changing surfaces. If the rib 30B is not contiguous, another means of cartridge retention in the forward direction, such as engaging in cartridge case flanges 38A, must be maintained until the cartridge 38 encounters the rib or ribs 30B. In such a design, the top ribs 30B can be provided by an additional piece whose function would be to both contain the cartridge stack against the spring 36 and to prevent forward axial motion of the top cartridge 38.

The tubular structure 30A can be made from a single piece, but two pieces is preferred since the rib 30B needs to maintain a reasonably square edge to guide the case mouth 38B. Additionally, two-piece construction allows the rib 30B component of the body 30A to be made of a thicker material, making it dimensionally more stable and resistant to deformation. The spring 36 is rectangular in a substantially rectangular form and has a very short solid height so as to maximize cartridge space. The floor plate 37 is affixed to the bottom of the tubular structure 30A to contain spring 36.

Extractor Locking Components

The barrel 26 is vertically captured between two components: the sliding bolt 24 on top, and the unlock block 62 on the bottom, which is mounted to the frame 22 (FIG. 1 & FIG. 13 & FIGS. 14A-14B). The barrel 26 is comprised of a long cylindrical body with rotary breech-locking lugs 78, a rotation lug 70 which cooperates with the rotation groove 72 in the unlock block 62, and a barrel rib 74, which cooperates with the extractor rib 76. The unlock block 62 contains the rotation groove 72 that receives the barrel rotation lug 70. The rotation groove 72 is comprised of a straight section that is parallel to the barrel, and a helical section that serves to cam the rotation lug 70 in the circumferential direction thereby rotating the barrel 26 so that its rotation lugs can unlock from the slide body or sliding bolt.

Operation

Magazine Loading Process

Figure 2:
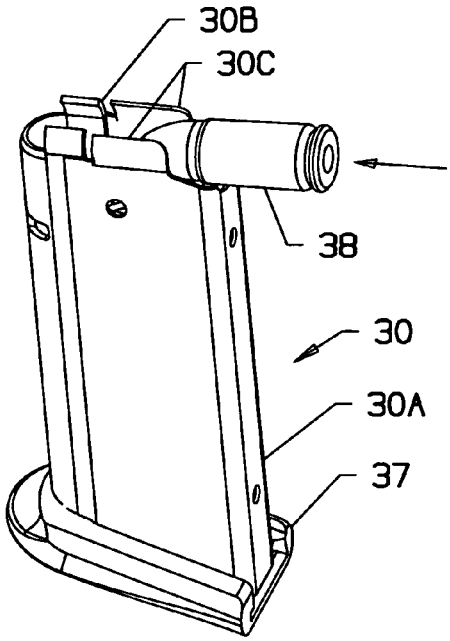
FIG. 2 shows a single-stack magazine being loaded from the rear.
Figure 3:
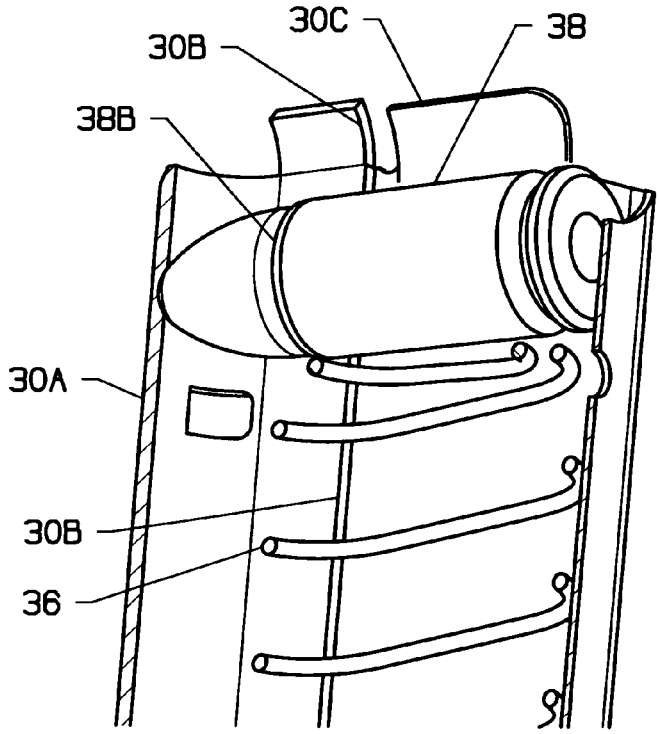
FIG. 3 is a cross section of a single column magazine with a cartridge inside FIG. 4 show the pair of tongs separated and laid flat

Unlike traditional cartridge feeding systems, cartridges 28 are loaded into the magazine 30 from the rear (FIG. 2 & FIG. 3). With the bullet pointing forward, the first cartridge 38 is placed on top of the spring 36, with a forward force to register the case mouth 38B against the rib 30B; the subsequent cartridges 38 are placed on top of each other while pushing each cartridge fully forward.

Similar to traditional feeding systems, the cartridge magazine 30 is inserted into the magazine well from the bottom of the frame and retained with a magazine release.

Magazine Extraction Process

Figure 4:
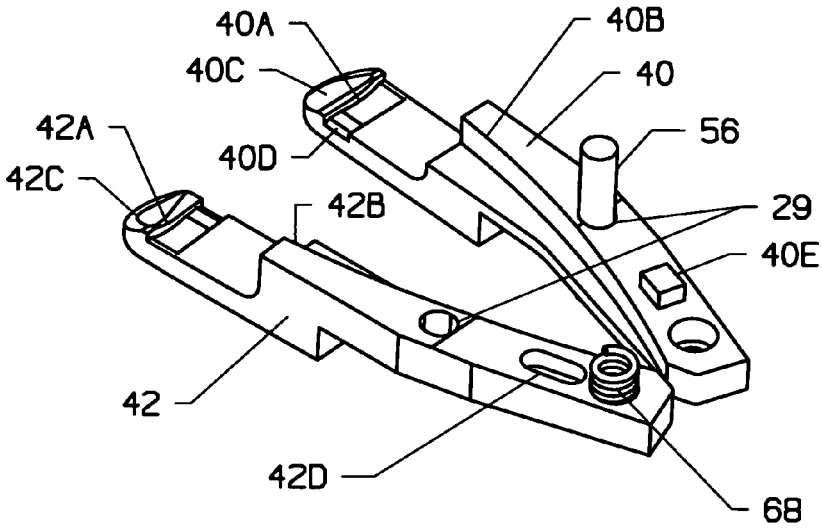
Figure 5:
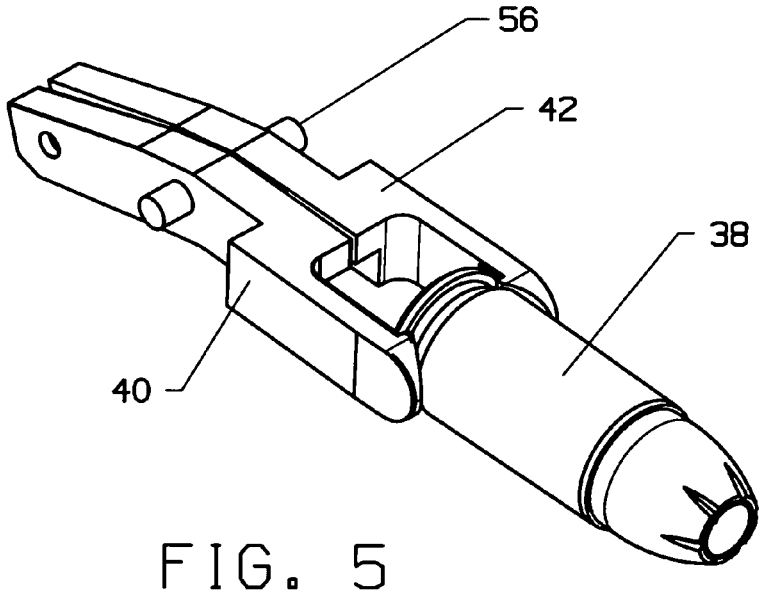
FIG. 5 shows the pair of tongs holding a cartridge
Figure 6:
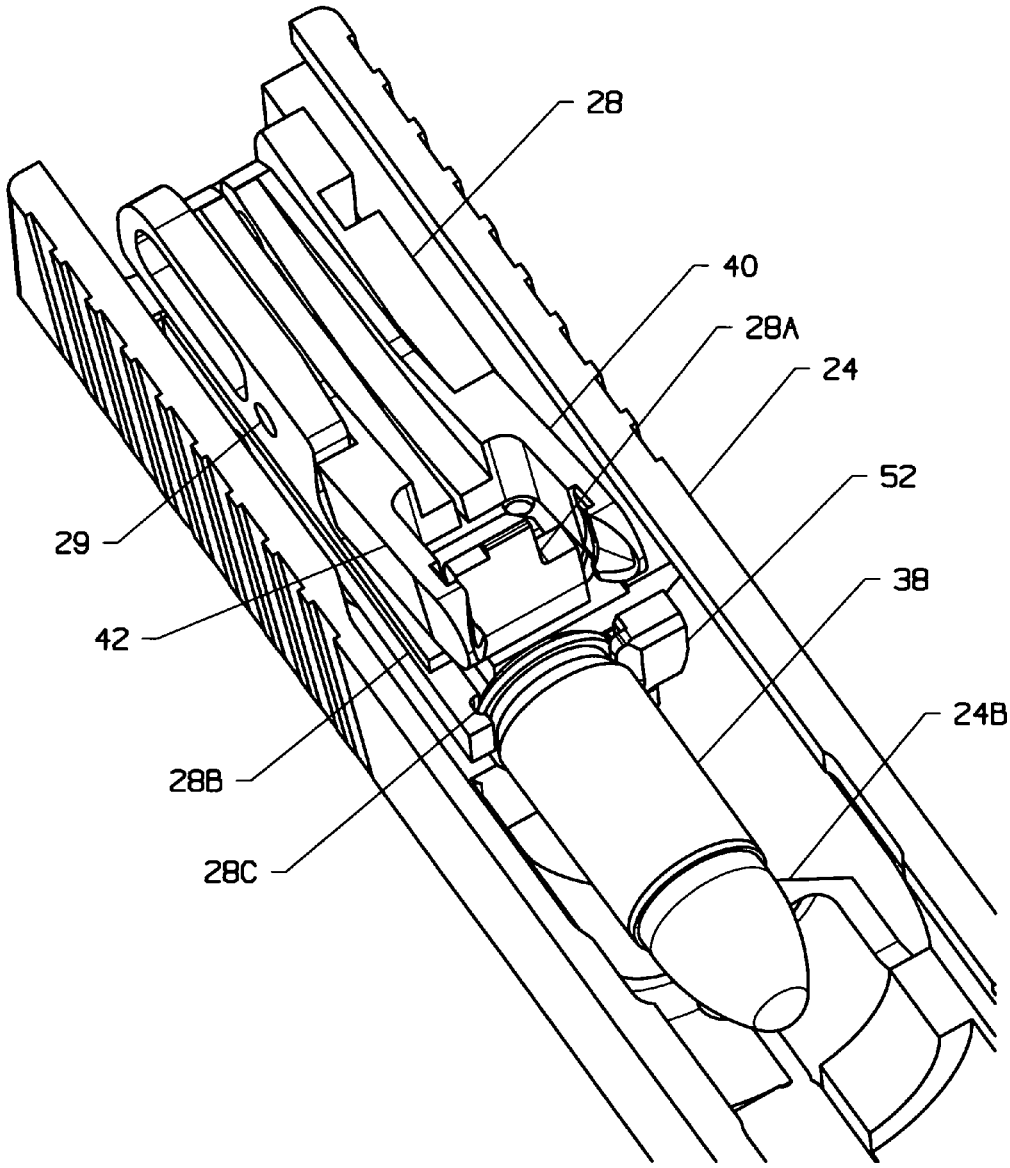
FIG. 6 shows the underside of the slide with a cartridge being held in the breech area

There are two modes for the tongs 40 & 42 to attach to uppermost cartridge 38 in magazine 30 (FIG. 4 & FIG. 5 & FIG. 10A). The first is the insertion of the magazine 30 into the frame 22 whereby the case flange 38A of top cartridge enters the spring-loaded tongs 40 & 42 via the lower inlet 40D on each tong. The tongs 40 & 42 spread apart as the case flange 38A slides between them. The second mode of attachment is by the return of the sliding bolt assembly 23 (FIG. 10E). Since the lifting mechanism 45 has at this point returned to the lower position, the first link 50 is also in its lower position, allowing cam back 50C to operate against the grooves in the tongs 40B & 42B to pivot them down as the sliding bolt 24 moves forward. Lead-ins 40C & 42C on the front of each tong 40 & 42 will slide over the back of the case flange 38A, forcing the tongs 40 & 42 apart against the tong spring 68, until the grip edges 40A & 42A of the tongs 40 & 42 have snapped over the case flange 38A. Some tong overtravel, usually more than 0.015-inch, is required to guarantee complete snap-over.

Once the tongs 40 & 42 are attached to the top cartridge 38 in the magazine 30, and a fresh cartridge 38 is in the chamber, the gun 20 is ready to fire and feed a cartridge 38 at the same time (FIG. 10A). At the time of percussion, the sliding bolt assembly 23 begins rearward travel and insert block's 28 inertia resists motion, causing the flexible pin 32 to bend, allowing the insert block 28 and on-board tongs 40 & 42 to momentarily remain in place. The flexible pin 32 then begins to spring back, allowing the insert block 28 to gradually catch up with the sliding bolt 24, delaying and softening rearward acceleration of the cartridge 38 being gripped by the tongs 40 & 42, thus minimizing possible separation of bullet from cartridge case. Typically, the gap 64 between the slide and insert block should be 0.014-inch or more. A suitable material for the flexible pin would be a commercially available coiled roll pin in alloy steel or stainless steel.

Since cartridges are positively drawn from the magazine 30, there is no need for a lower guiding surface inside the magazine, such as a magazine follower used in traditional magazines. Another feature of the magazine extraction process is the presentation angle 31 of the uppermost cartridge 38 (FIG. 10A). The key is to have the angle between the axis of the cartridge and the line defined by the cartridge gripping point and tong pivot to be a non-zero value, more preferably 3 degrees or more. That way, during percussion, the rearward acceleration of the cartridge 38 is softened by the fact that the cartridge 38 must straighten out its angle to zero degrees relative to the tongs 40 & 42 before any significant rearward motion of the cartridge 38 can occur.

Due to the very high acceleration experienced by the sliding bolt assembly 23, precaution must be taken in the design of the hammer 44. The contact point between the hammer 44 and the insert block 28 must be kept as high in elevation as possible, to minimize the angular velocity of the hammer 44, to prevent it from severely over-traveling and damaging the frame 22.

Lifting Mechanism Sequence

As a cartridge 38 is drawn from the magazine 30, it is presented to the lifting mechanism 45 which is at rest in its lowermost position. The cartridge 38 first encounters the forward slope 46A on the ramp 46, which steers the cartridge 38 in an upward direction toward the spent case 38C being extracted from the chamber, which helps limit the vertical travel of the cartridge 38 as it slides along the top surface of the ramp 46 (FIG. 10B). For a short time, the cartridge 38 and spent case 38C are substantially parallel to each other, until the secondary block abutment 28A catches the first cam surface 50A and begins the actuation of the lifting mechanism 45 (FIG. 10C). Since the sliding bolt 24 is normally moving very fast, the motion imparted to the lifting mechanism 45 is also very fast, and causes the cartridge 38 to rise abruptly. While moving upward, the ramp 46 can absorb some of the impact against the cartridge 38 by flexing downwardly. The rising of the cartridge 38 continues as the spent case 38C strikes the ejector 54. The spent case 38C is also being affected by the cartridge 38 from below by being wedged away from the inboard side of the ejection area in a manner that amplifies the ejection velocity of the spent case 38C. In other words, both the ejector 54 and the cartridge 38 are impacting the spent case 38C simultaneously.

With the spent case 38C fully clear of the breech area, the cartridge 38 continues upwardly, bringing along tongs 40 & 42, which are still attached to the cartridge 38. The tongs 40 & 42 cease pivoting motion when stopping against the underside of the secondary block 28 (FIG. 10D). With the lifting mechanism 45 continuing, the case flange 38A will leave the tongs 40 & 42, spreading them apart against the tong spring 68, and entering the cartridge breech face 25 for the cartridge 38 to be trapped.

While the lifting mechanism 45 link members can have different lengths, in practice it is desirable to have all four pivots of the lifting mechanism 45 form a parallelogram so that substantially parallel motion is imparted to the cartridge 38 during lift. In other words, the first link 50 and the second link 48 should be the same length, and the third link body 51 and the ground link (frame 22 pivot distance) should be the same length (see FIG. 9). Non-parallel motion can cause the cartridge 38 to tilt in an undesirable way.

Ejector Bypass

Figure 11:
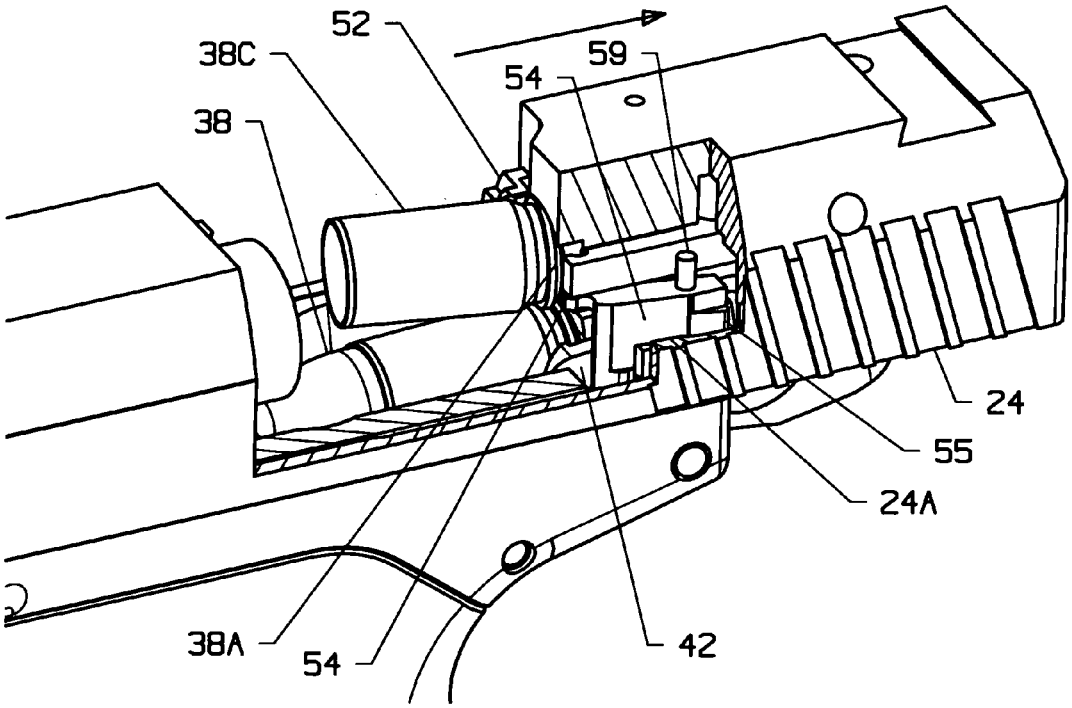
FIG. 11 shows the spent case starting ejection, the cartridge below rising, and the ejector being cammed out of its way
Figure 12A:
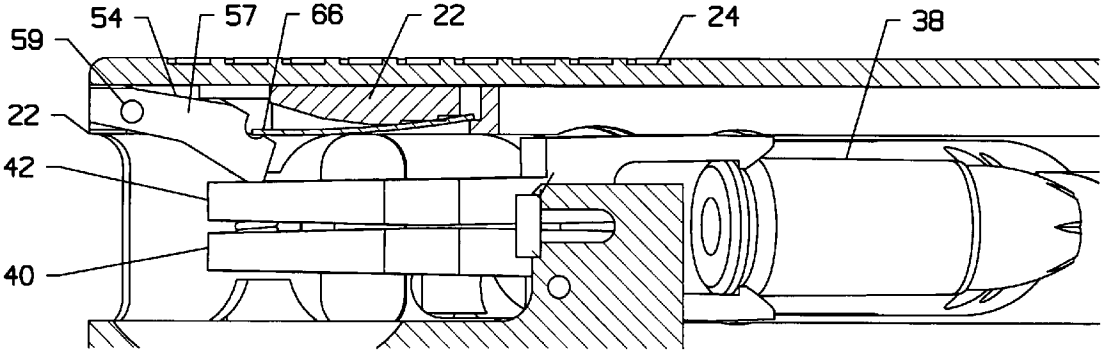
FIGS. 12A-B are horizontal cross-sections looking down at the gun through the top of the slide
Figure 12B:
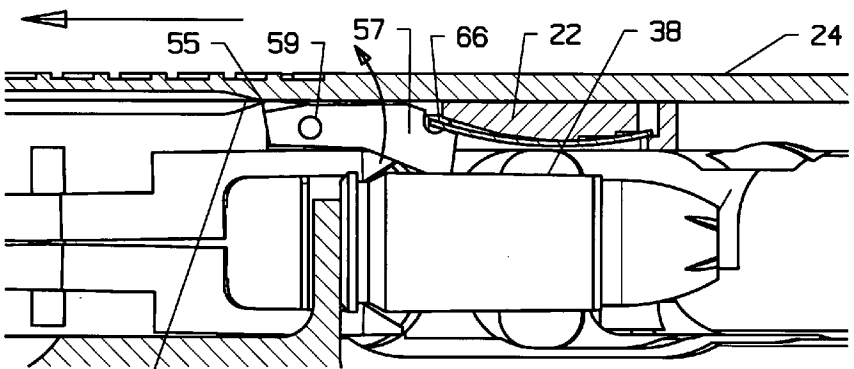

The receding spent case 38C is removed by striking the ejector lever 54, but as the new cartridge 38 rises, the ejector 54 must now move out of the way to prevent it from contacting and diverting the cartridge 38 (FIG. 11, FIGS. 12A & 12B). This is done by a cam surface 24A integral with the sliding bolt 24 acting upon the tail of the ejector lever 55. This is timed so that just after the ejector has been struck by a spent case, it begins to rotate about its pivot 59 out of the way of a rising cartridge 38. The ejector 54 maintains its out-of-the-way position (FIG. 12B) as the sliding bolt 24 finishes its rearward travel.

Cartridge Trap

As the cartridge 38 is lifted past the tongs 40 & 42, it enters into the breech face 25 region by sliding under the spring-loaded extractor 52. Opposing the extractor spring on the opposite side of the breech face 25 is the grip slot 28C (FIG. 6), which receives the case flange 38A and guides it during lift and when it arrives at top position. Just before the cartridge 38 reaches its top position, the sliding bolt assembly 23 has some remaining travel, but the lifting mechanism 45 is near toggle and will provide almost no additional lift. However the remaining slide 24 travel will impart additional rotation of the first cam surface 50A to act upon the ramp 46 to provide additional lift to the cartridge 30A (FIG. 10D). This lifting amplification allows the lifting mechanism 45 to be more compact.

The cartridge 38 reaches its upper travel limit when its case flange 38A touches the flange stop or first concave surface 28E and the case mouth 38B area nests into the concave ceiling or second concave surface 24B (FIG. 10D). Both concave surfaces are built in to the sliding bolt. Although the cartridge 38 has stopped, the flip link nose 50A continues to rotate somewhat more, forcing the flexible tang 46 to bend against the case of the cartridge 38, effectively clamping it against the concave upper surfaces 28E and 24B, completing the trapping process.

In practice, it is desirable to have the cartridge 38 lifted slightly above the barrel 26 axis when it is trapped. This reduces the tilt angle of the trapped cartridge 38 thus reducing stress on the extractor 52 and potential case flange 38A cam-out from under the extractor 52.

Cartridge Delivery to Chamber

Upon return of the slide 24 to battery, the cartridge 38 must now move down to become co-linear with the barrel 26 so that it can enter the chamber without requiring excessive lead-ins. This vertical offset should not exceed 0.070" or the flat noses of some hollow point ammunition can catch on the chamber face. Typically, an offset of 0.035-0.060" works best. For proper lead-in, a small chamfer of 0.015"-0.020" on the chamber mouth is required.

Extractor Locking

Figure 13:
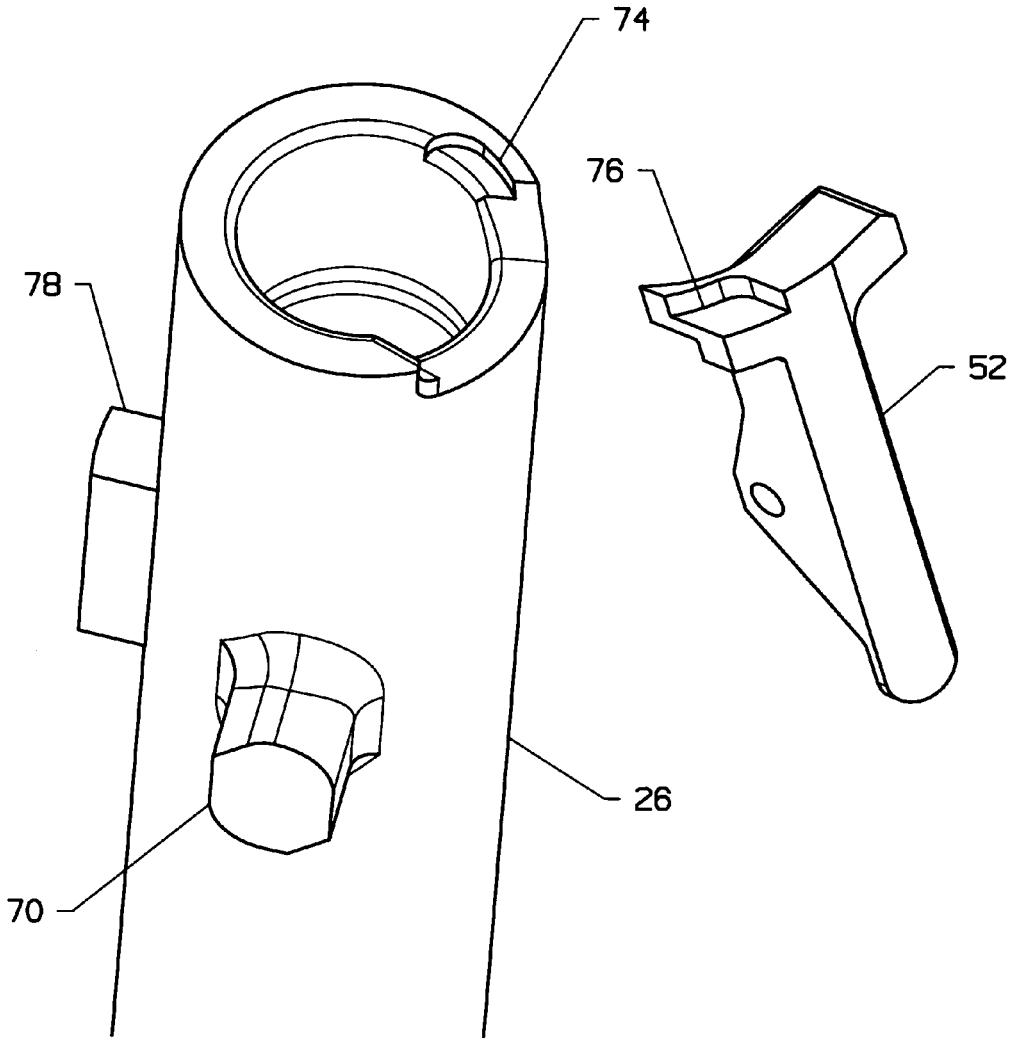
FIG. 13 shows features on the barrel and ejector that allow for ejector locking
Figure 14A:
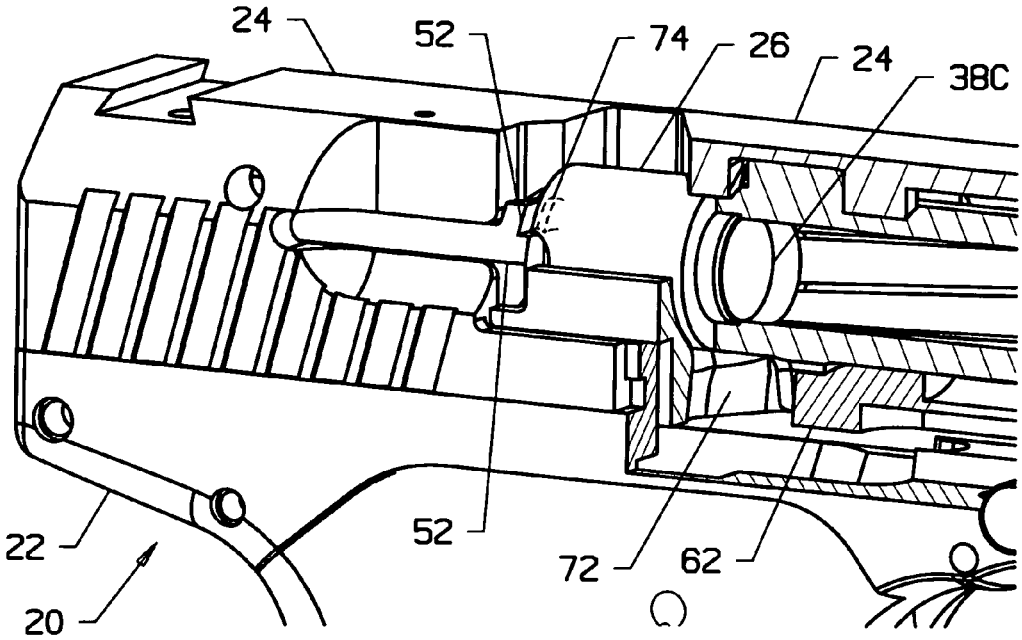
FIG. 14A shows the barrel and ejector locked in battery position
Figure 14B:
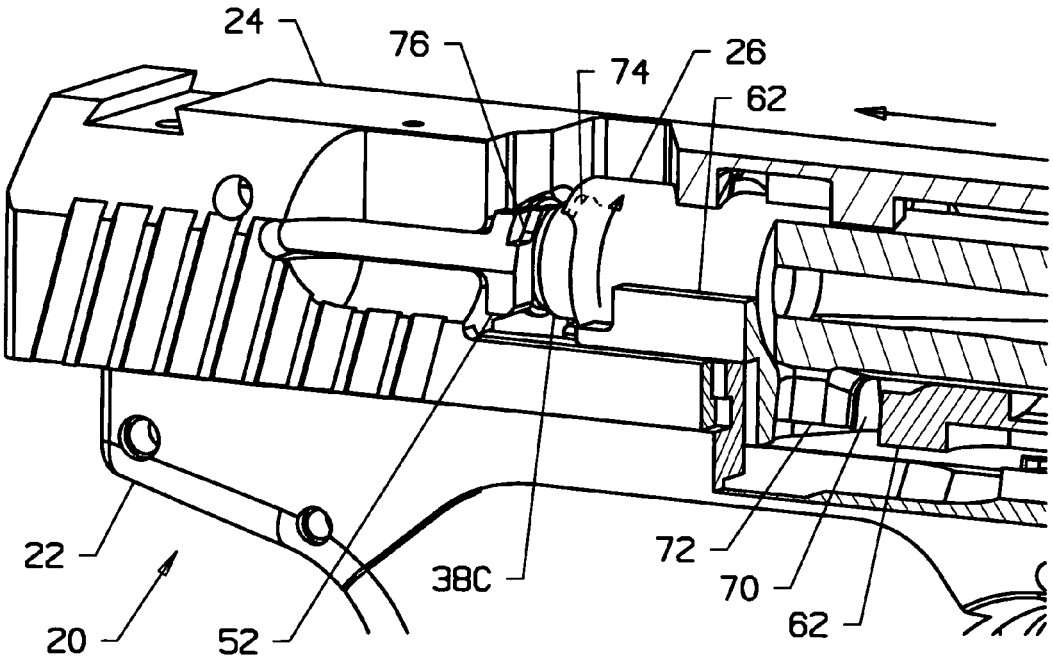
FIG. 14B shows the slide somewhat back with the ejector unlocked from the barrel

When the sliding bolt 24 and barrel 26 are at rest in the battery position, the barrel rib 74 overlaps with the extractor rib 76 (FIG. 13 & FIGS. 14A-14B). After cartridge ignition, some gases escape rearward from the chamber, trying to force the extractor 52 to disengage with the case flange 38A. However, the barrel rib 74 inhibits extractor pivoting until chamber gas pressure has significantly dropped. Recoil drives the barrel 26 and slide 24 rearward as the rotation lug 70 slides in the rotation groove 72 until it encounters the helical surface, which forces the barrel 26 to turn about its axis. By this time, the bullet has left the barrel 26 and chamber pressure has dropped to a level where extractor 52 blow-out can no longer occur. Barrel rotation continues until the extractor 52 is unlocked from the barrel 26. Shortly thereafter the rotation also unlocks the barrel 26 from the slide 24, allowing the barrel 26 to stop and the slide 24 to continue rearward.

Description and Operation of Alternative Embodiments

Dual-Column Magazine

A single-column magazine provides for a thinner gun for better concealment; however, a dual-column magazine results in greater capacity. In FIG. 15 A, 15B, 15C and Detail AD we see a tubular structure 84 that is modified to include a wide section to contain a double column of cartridges 38 that converges into a single column. Although the invention relies on case-mouth location at the top position, which is provided by tightly spaced ribs 88, it is not practical to guide two columns of cartridges this way. Instead, two rails 86, formed by bending the edges of the tubular structure, engage the cannelures 39 to contain the alternating cartridges axially until the two columns merge into a single column, where case mouth location can be accomplished with the ribs. The spring 90 pre-loads the cartridge 38 stack and cannelures 39 against the opposing rails 86. The floor plate 82 then caps off the bottom of the magazine. To guarantee that no forward axial movement of the cartridge is experienced during this transition, the rails 86 overlap with the ribs 88. Lips 92 are also used on this design to oppose the magazine spring 90. The floor plate 82 is attached the same way as a single-column magazine. Cartridges 38 are drawn from the rear by the tongs 40, 42.

Bottle-Necked Cartridge Magazine

Bottle-necked cartridges 94 present an opportunity for simplification of the magazine design. FIG. 16 shows the proposed magazine 98. Instead of using contiguous ribs to guide the case mouth, angled folds 100 are used to register against the shoulder 96 of the bottlenecked cartridge 94. All other features and functions would be identical to a case-mouth guided magazine.

Dual-Column Bottle-Necked Cartridge Magazine

Figure 15A:
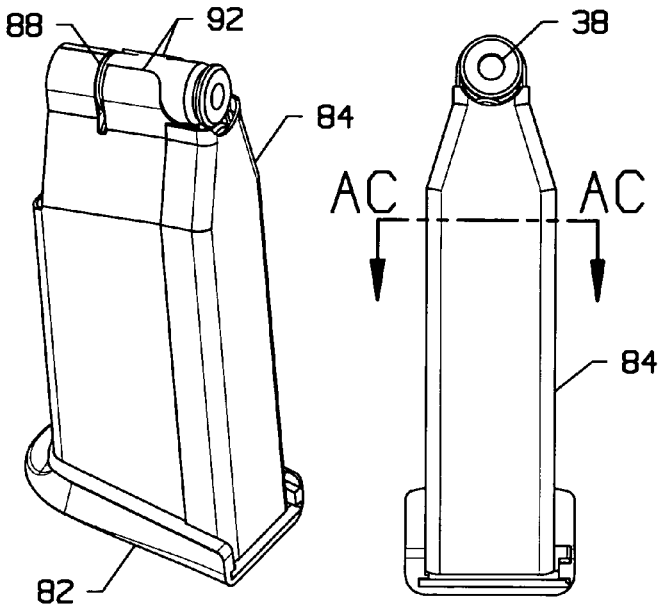
FIG. 15A shows the overall view of a double-column magazine
Figure 15B:
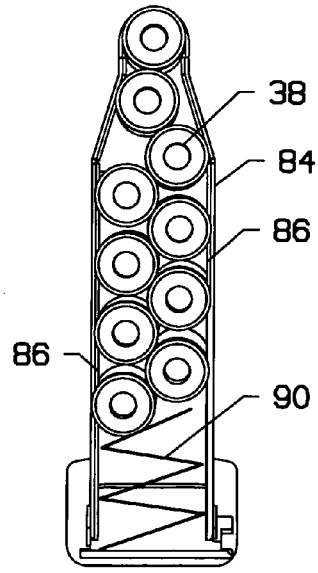
FIG. 15B shows a vertical cross section of a double-column magazine
Figure 15C:
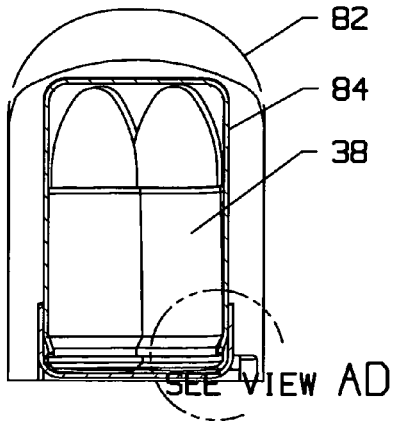
FIG. 15C shows a horizontal cross section and detail view of cartridge locating features
Figure 15C:
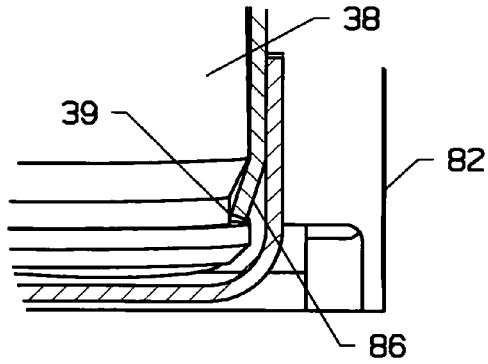

This magazine would be analogous to the dual-column case mouth guided magazine shown in FIG. 15C, except folds 100 would be used at the top instead of ribs 88. Case flanges would be engaged by rails folded into the edge of the magazine body.

Single-Piece Sliding Bolt

The sliding bolt assembly has been defined as a three-element construction, relative to the invention. However, one element can be removed, the secondary block 28, can be eliminated by incorporating its features into the slide itself. The tongs 40 & 42 would then directly hinge to the slide.

Passive Ejector

A simpler extractor design would be to have the cartridge itself move the ejector lever out of the way. This would eliminate the need to machine a cam into the slide and would allow more lenient manufacturing tolerances of the related parts. The risk would be that the cartridge could be steered out of the weapon by the ejector spring force. Careful selection of an ejector spring and careful design of a lead-in on the underside of the ejector may overcome these issues.

CONCLUSION

It is thus evident that in the magazine cartridges are kept in forward alignment via case mouth registration. It is also evident that after a cartridge is drawn rearward from the magazine, it is guided, lifted, trapped and carried into the barrel chamber. It is additionally evident that the chamber extractor is locked during ignition and is automatically unlocked significantly after ignition. This arrangement affords reliable cartridge feeding, due to positive cartridge control at all times, and maximum kinetic energy of the bullet due to additional barrel length extending over the magazine.

While the above description contains numerous specificities, these should not be construed as limitations on the scope of the invention, but as exemplifications of the presently preferred embodiments thereof. Many other ramifications and variations are possible within the teachings of the invention, such as using the invention in rifles, machine guns and artillery. Thus, the scope of the invention should be determined by the appended claims and their legal equivalents, and not by the examples given.

I claim:

1. A firearm, comprising:

a frame;

a barrel having a chamber at one end and joined to said frame;

a cartridge magazine selectively joinable to said frame to position a cartridge aligned substantially vertically transverse with the chamber;

a sliding bolt configured to reciprocate relative to the frame between an in-battery position and a rearward position and to receive the cartridge in a position substantially in axial alignment with the chamber when in the rearward position;

a magazine extractor mechanism configured to engage and extract a cartridge rearwardly from the magazine when the bolt reciprocates toward the rearward position; and a cartridge lifting mechanism actuated by rearward reciprocation of the sliding bolt to move a cartridge away from engagement by the magazine extractor mechanism and upward into retention by the slide bolt.

2. The device of claim 1 wherein the cartridge lifting mechanism further comprises:

a first link, a second link and a third link, the first and second links being pivotally joined to said third link and opposite ends of the first and second links being pivotally mounted to pivot points a fixed distance from each other.

3. The device of claim 2 wherein the third link further comprises a platform configured to confront a side surface of a cartridge when fully withdrawn from the magazine and having a forward a ramp portion configured to guide the cartridge as it is withdrawn from the magazine and from an angled position into a position substantially parallel with the barrel.

4. The device of claim 3 wherein the platform has a flexible end portion.

5. The device of claim 4 wherein the flexible end portion is cantilevered.

6. The device of claim 5 wherein the flexible end portion is selectively moved from a position substantially parallel to the third link to an angled position, further elevating the platform and cartridge as the slide bolt approaches its rearward position of travel.

7. The device of claim 1 wherein the cartridge magazine has at least one internal rib configured to confront an edge of a cartridge case mouth and rearwardly position at least one cartridge positioned in the magazine ready for extraction, thereby maintaining proper alignment of the cartridge for engagement by the magazine extractor mechanism according to cartridge case length rather than overall cartridge length.

8. The device of claim 7 wherein the rib extends along an entire column of cartridges.

9. The device of claim 6 wherein the first link includes a cam extension portion configured to move the flexible end portion of the platform to the angled position as the slide bolt approaches its rearward position of travel and the lifting mechanism moves the cartridge away from engagement by the magazine extractor mechanism and upward into retention by the slide bolt.

10. The device of claim 9 wherein the flexible end portion of the platform is spring biased toward the position substantially parallel to the third link.

* * * * *